US009007285B2

(12) United States Patent
Yang

(10) Patent No.: US 9,007,285 B2
(45) Date of Patent: Apr. 14, 2015

(54) MULTI-LINE ADDRESSING METHOD AND APPARATUS FOR BISTABLE DISPLAY

(75) Inventor: Chang-Jing Yang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 309 days.

(21) Appl. No.: 13/611,938

(22) Filed: Sep. 12, 2012

(65) Prior Publication Data

US 2013/0076606 A1 Mar. 28, 2013

Related U.S. Application Data

(60) Provisional application No. 61/537,793, filed on Sep. 22, 2011.

(51) Int. Cl.
*G09G 3/36* (2006.01)
*G09G 3/34* (2006.01)

(52) U.S. Cl.
CPC ..... *G09G 3/34* (2013.01); *G09G 2310/0205* (2013.01); *G09G 2310/0213* (2013.01); *G09G 2320/0613* (2013.01)

(58) Field of Classification Search
CPC ..... G09G 3/34; G09G 2320/0613; G09G 2310/0213; G09G 2310/0205
USPC ..... 345/87, 76
See application file for complete search history.

(56) References Cited

U.S. PATENT DOCUMENTS 6,504,524 B1 1/2003 Gates et al.
6,597,119 B2 7/2003 Ito
6,967,658 B2 * 11/2005 Hunter et al. ..... 345/473
7,944,410 B2 * 5/2011 Smith et al. ..... 345/76
2003/0076455 A1 * 4/2003 Kwok et al. ..... 349/99
2007/0070001 A1 3/2007 Martinot-Lagarde et al.
2009/0174651 A1 7/2009 Jacobson et al.
2011/0096088 A1 * 4/2011 Lee et al. ..... 345/596

FOREIGN PATENT DOCUMENTS

CN 101065794 A 10/2007
CN 101241687 A 8/2008
TW 344042 11/1998

(Continued)

OTHER PUBLICATIONS

Euan C. Smith, "Total matrix addressing", *Journal of the SID*, 2008, pp. 201-209, vol. 16, Issue 2. (Extended revised version of a paper presented at the 2007 SID Symposium, Seminar & Exhibition (SID '07,) held in Long Beach, California, May 20-25, 2007.).

(Continued)

*Primary Examiner* — Kwang-Su Yang

(74) *Attorney, Agent, or Firm* — Muncy, Geissler, Olds & Lowe, P.C.

(57) ABSTRACT

A multi-line addressing method and a multi-line addressing apparatus for a bistable display are disclosed, where the multi-line addressing method for a bistable display comprises steps as outlined below. First, a basis matrix based on a digital image is provided. Then, the basis matrix is factorized by searching independent vectors in the basis matrix, thereby reducing the rank of the basis matrix. Then, a plurality of addressing signals based on the factorized basis matrix is sent to a rectangular array of pixels of the bistable display.

9 Claims, 4 Drawing Sheets

(56) References Cited

FOREIGN PATENT DOCUMENTS

| | | |
|---|---|---|
| TW | 200512492 A | 4/2005 |
| TW | I283790 | 7/2007 |

OTHER PUBLICATIONS

Temkar N. Ruckmongathan, "Novel Addressing Methods for Fast Responding LCDs", *Reports Res. Lab. Asahi Glass Co., Ltd.*, 1993, pp. 65-97, vol. 43, Issue 1.

S. Kaneko et al., "Multiline Driving of Quick-Response Liquid Powder Display (QR-LPD) with Non-negative Matrix Factorization", *Proc. IDW '08*,, 2008, pp. 1267-1270.

Michihiro Asakawa et al., "Multi-Line Driving of QR-LPD", *Technical Report of IEICE*, 2008, pp. 93-96, vol. 107, No. 453.

Michihiro Asakawa et al., "Shrunk multiline addressing method in a passive-matrix-driven liquid powder display", *Journal of the SID*, 2011, pp. 693-699, vol. 19, Issue 10.

Michihiro Asakawa et al., "Improvement of Contrast Ratio in QR-LPD by Four-Voltage Level Driving", *Proc. of ASID '06, New Delhi*, Oct. 8-12, 2006, pp. 148-151.

Daniel D. Lee et al., "Algorithms for Non-negative Matrix Factorization", *Proc. of Neural Information Processing Systems*, 2000, 7 pages.

* cited by examiner

MULTI-LINE ADDRESSING METHOD AND APPARATUS FOR BISTABLE DISPLAY

RELATED APPLICATIONS

This application claims priority to U.S. Provisional Ser. No. 61/537,793, filed Sep. 22, 2011, which is herein incorporated by reference.

BACKGROUND

1. Technical Field

The present disclosure relates to addressing methods and apparatus for displays, and more particularly, multi-line addressing methods and apparatus for bistable displays.

2. Description of Related Art

What distinguishes a bistable display from other type display is that after power is removed, whatever is currently showing remains until the next time the power is restored and the image is refreshed. In short, the image is either bistable or stable in two (or maybe more) states. Since computer displays are often static for long periods of time, such as during a lunch break in office, power of the display could be turned off during those periods for conserving battery life, since the active display is one of the largest consumers of power in any portable computer system.

FIG. 1 is a schematic drawing of a conventional addressing method for the bistable display that includes columns (e.g., Columns 1, 2 and 3) and rows (e.g., Rows 1, 2 and 3) arranged in a matrix form. In the conventional addressing method, a signal during a full period is sent to Row 1, and pulses are sent to Columns 1, 2 and 3, respectively, where the respective pulses each may have various widths for displaying different gray levels in Row 1. Next, an another signal during the full period is sent to Row 2, and pulses are sent to Columns 1, 2 and 3, respectively, where the respective pulses each may have various widths for displaying different gray levels in Row 2. Next, a yet another signal during the full period is sent to Row 3, and pulses are sent to Columns 1, 2 and 3, respectively, where the respective pulses each may have various widths for displaying different gray levels in Row 3. In the conventional addressing method, however, a long driving waveform is required to show an image with high contrast and uniform grayscale distribution. Therefore, there is a need for solving this problem, and the present disclosure meets this need.

SUMMARY

The following presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

In this disclosure, multi-lines addressing (MLA) scheme for a bistable display has been disclosed. The inventor modifies the cost function and proposes a fast algorithm of lossless matrix factorization (LMF). The experiment results show that the faster image-refreshing rate is achieved.

According to one embodiment of the present disclosure, a multi-line addressing (MLA) method for a bistable display comprises as outlined below. First, a basis matrix based on a digital image is provided. Then, the basis matrix is factorized by searching independent vectors in the basis matrix, thereby reducing the rank of the basis matrix. Then, a plurality of addressing signals based on the factorized basis matrix is sent to a rectangular array of pixels of the bistable display.

According to another embodiment of the present disclosure, a multi-line addressing (MLA) apparatus for a bistable display comprises a processor unit and a driving unit. The processor unit can factorize a basis matrix based on a digital image, in which the processor unit comprises a first searching module for searching independent vectors in the basis matrix, thereby reducing the rank of the basis matrix. The driving unit can send a plurality of addressing signals based on the factorized basis matrix to a rectangular array of pixels of the bistable display.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawing, wherein.

DETAILED DESCRIPTION

Figure 1:
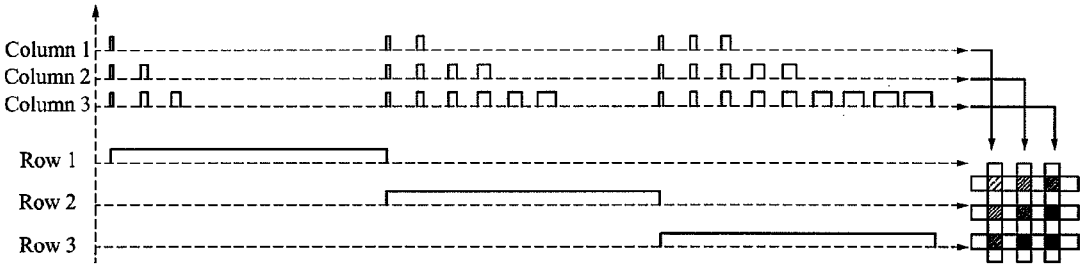
FIG. 1 (PRIOR ART)
FIG. 1 is a schematic drawing of a conventional addressing method for a bistable display.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
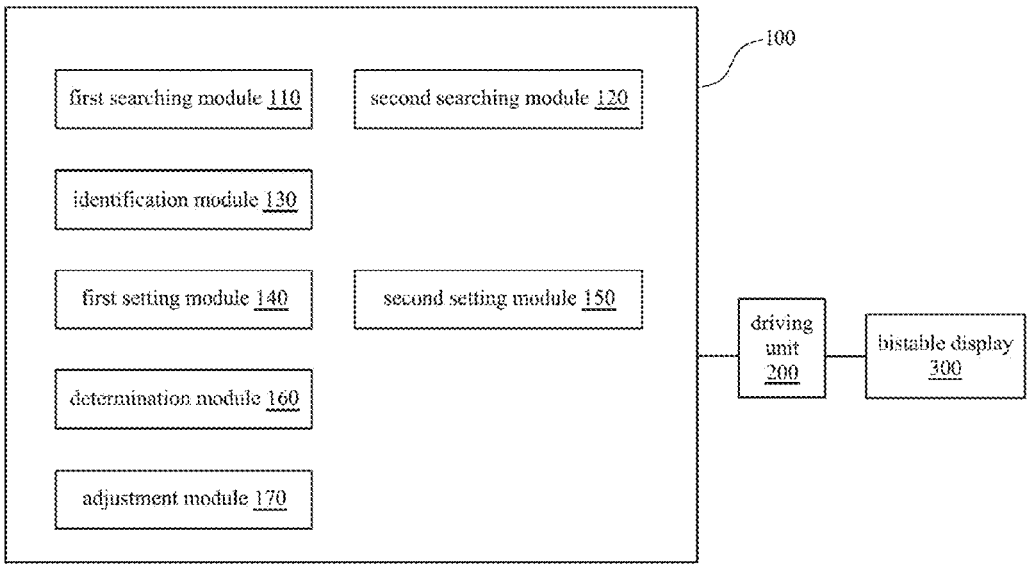
FIG. 2 is a block diagram of a multi-line addressing apparatus according to one or more embodiments of the present disclosure.

With reference to FIG. 2, a multi-line addressing (MLA) apparatus for a bistable display 300 comprises a processor unit 100 and a driving unit 200. The processor unit 100 is coupled with the driving unit 200, and the driving unit 200 is coupled with the bistable display 300. For example, the processor unit 100 and the driving unit 200 may be integrated into the bistable display 300 (not shown in FIG. 2); or alternatively, the processor unit 100, the driving unit 200 and the bistable display 300 may be integrated in a display device (not shown in FIG. 2).

The processor unit 100 can factorize a basis matrix based on a digital image, in which the processor unit 100 comprises a first searching module 110 for searching independent vectors in the basis matrix, thereby reducing the rank of the basis matrix. The driving unit 200 can send a plurality of addressing signals based on the factorized basis matrix to a rectangular array of pixels of the bistable display 300. Because the basis matrix is simplified, the multi-line addressing (MLA) apparatus is fast in the image-refreshing rate without wasting electricity.

The processor unit 100 may further comprise a second searching module 120. The second searching module 120 can search linear dependent vectors in the basis matrix, and thus allocate weights to the searched linear dependent vectors respectively. In this way, the basis matrix is further simplified.

Specifically, a matrix factorization without loss should be conducted when MLA scheme is employed. The objective is modified to minimize rank of basis matrix, and since the constrains of A=WH, the factorization of image A is therefore lossless. Moreover, the quantization loss is not present since the components of basis and coefficient matrix are natural number. The cost function of LMF is represented as, min Rank (W)
st.
$A=WH$
$W_{ij}, H_{ij} \in N$ The basic concept of presented algorithm is to reduce the rank of image A. Assume that the image $A=[a_1 \ldots a_m]$ is a n×m matrix and the basis matrix $W=[w_1 \ldots w_r]$ and the coefficient $H=[h_1 \ldots h_r]^t$ are factorization matrices of rank r. The update rules is shown as below, 1. W=0; H=0
2. for I=1:m
   key=$a_i$; j=0
   while key≠0
      if $w_j \neq a_i$ and $w_j=0$
      $w_j=a_i$; $H_{j,i}=1$
         break
   elseif $w_j$=key
   $H_{j+1,i}=1$; j=j+1
   break
   j=j+1

The presented algorithm finds the independent vectors of image A. When the column vector $a_i$ of image A is identical to the vector $w_j$ of basis matrix W, the algorithm neglects the column vector $a_i$ and allocates a weight to $H_{j,i}$ of the coefficient matrix. On the contrary, the column vector $a_i$ is added into the basis matrix when it is independent to the vectors $w_j$ of basis matrix W and a weight is allocated to $H_{j,i}$ as well.

The algorithm searches m vectors of A that match with the basis vectors of W. The worst case of the computation time of presented algorithm is $O(m^2)$ . The presented algorithm reduces the rank of the basis matrix W by eliminating the redundancy of vectors $w_j$ of basis matrix W. The number of reduced rank depends on the independent basis vectors of image A. In practice, the basis matrix W can be composed by the row vectors or by the column vector of image A. For the sake of fast addressing, the larger size of vector is chosen to the vectors of basis matrix.

Moreover, the processor unit 100 may further comprise an identification module 130, a first setting module 140, and a second setting module 150. The identification module 130 can determine whether the digital image is a text-based image, or a picture-based image, or even a hybrid thereof. The first setting module 140 can set the basis matrix for a first factorization level when the digital image is the text-based image. The second setting module 150 can set the basis matrix for a second factorization level when the digital image is a picture-based image, where the first factorization level is different from the second factorization level, and the first factorization level and the second factorization level can both defined as need. Moreover, it is noted that any other factorization level could be set by adapting the first setting module 140 and the second setting module 150 properly, and it will be easily understood by skill in the arts.

The processor unit 100 may further comprise a determination module 160, and an adjustment module 170. When the digital image is the text-based image, the determination module 160 can determine whether an error between two independent vectors is within a first predetermined limit based on the first factorization level as mentioned. The adjustment module 170 can replace any one of the two independent vectors with the other when the error is within the first predetermined limit. Accordingly, the number of scanned vector of the proposed algorithm can be reduced. The acceptable errors between the original and factorized images are determined in determination module 160. Tradeoffs between the acceptable errors and the number of scanned vector occur when the determination module 160 is employed. The computation time is decreased when the number of scanned vector is decreased. However, the errors may be increased thereby.

Additionally or alternatively, when the digital image is the picture-based image, the determination module 160 can determine whether an error between two independent vectors is within a second predetermined limit based on the second factorization level. The adjustment module 170 can replace any one of the two independent vectors with the other when the error is within the second predetermined limit, where the first predetermined limit is different from the second predetermined limit, and the first predetermined limit and the second predetermined limit can both defined as need. Moreover, it is noted that any other limit could be set by adapting the adjustment module 170 properly, and it will be easily understood by skill in the arts.

In one embodiment, the bistable display 300 is a quick response liquid powder display (QR-LPD). The quick response liquid powder display (QR-LPD) is a low power reflective display that sustains the image with no power supply. This kind of display can adopt the passive matrix (PM) driving, so that a TFT (thin-film transistor) backplane is not necessary, and a large size or flexible-type panel can be realized without difficulty. However, the issue has risen that the updating time is getting longer with increasing the scanning line numbers. In an alternative embodiment, the bistable display 300 is a bistable electrophoretic display (EPD), a bistable twisted nematic liquid crystal display (TN-LCD), or the like.

The first searching module 110, the second searching module 120, the identification module 130, the first setting module 140, the second setting module 150, the determination module 160, and the adjustment module 170 may be functioned by hardware, software and/or (burn-in) firmware. For example, if an implementer determines that speed and accuracy are paramount, the implementer may optioned for a mainly hardware and/or firmware vehicle; alternatively, if flexibility is paramount, the implementer may optioned for a mainly software implementation; or, yet again alternatively, the implementer may optioned for some combination of hardware, software, and/or firmware.

Figure 3:
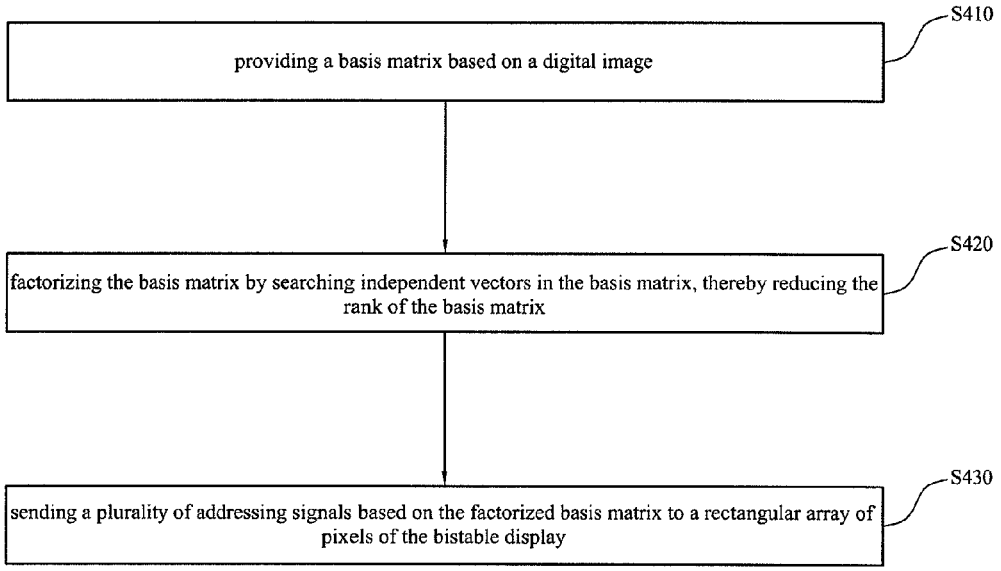
FIG. 3 is a flowchart of a multi-line addressing method according to one or more embodiments of the present disclosure.

FIG. 3 is a flowchart of a multi-line addressing method according to one or more embodiments of the present disclosure. As shown in FIG. 3, the multi-line addressing (MLA) method includes steps S410-S430 as follows. It is noted that the steps are not recited in the sequence in which the steps are performed. That is, unless the sequence of the steps as shown in FIG. 3 is expressly indicated, the sequence of the steps is interchangeable as default, and all or part of the steps may be simultaneously, partially simultaneously, or sequentially performed. It should be noted that those implements to perform the steps in the multi-line addressing (MLA) method are disclosed in above embodiments and, thus, are not repeated herein.

In step S410, a basis matrix based on a digital image is provided. In step S420, the basis matrix is factorized by searching independent vectors in the basis matrix, thereby reducing the rank of the basis matrix. In step S430, a plurality of addressing signals based on the factorized basis matrix is sent to a rectangular array of pixels of the bistable display.

In step S420, linear dependent vectors in the basis matrix are searched, and weights are allocated to the searched linear dependent vectors respectively.

The multi-line addressing (MLA) method may further comprise steps as outlined below. In the multi-line addressing (MLA) method, whether the digital image is a text-based image, or a picture-based image, or even a hybrid thereof is determined. The basis matrix is set for a first factorization level when the digital image is the text-based image; additionally or alternatively, the basis matrix is set for a second factorization level when the digital image is a picture-based image, where the first factorization level is different from the second factorization level, and the first factorization level and the second factorization level can both defined as need. level is determined, and then any one of the two independent vectors is replaced with the other when the error is within the first predetermined limit.

When the digital image is the picture-based image, in step S420 whether an error between two independent vectors is within a second predetermined limit based on the second factorization level is determined, and then any one of the two independent vectors is replaced with the other when the error is within the second predetermined limit, where the first predetermined limit and the second The driving voltage of bistable display is getting lower, but is, however, still higher than a conventional LCD, so that pulse number modulation (PNM) or pulse width modulation (PWM) is desirable for a gradation display, rather than pulse amplitude modulation (PAM) to show the halftone image because DAC (digital-analog conversion) circuit for high voltage needs a large area in LSI (large scale integration). In addition, PNM does not need a counter in each output circuit.

Figure 4:
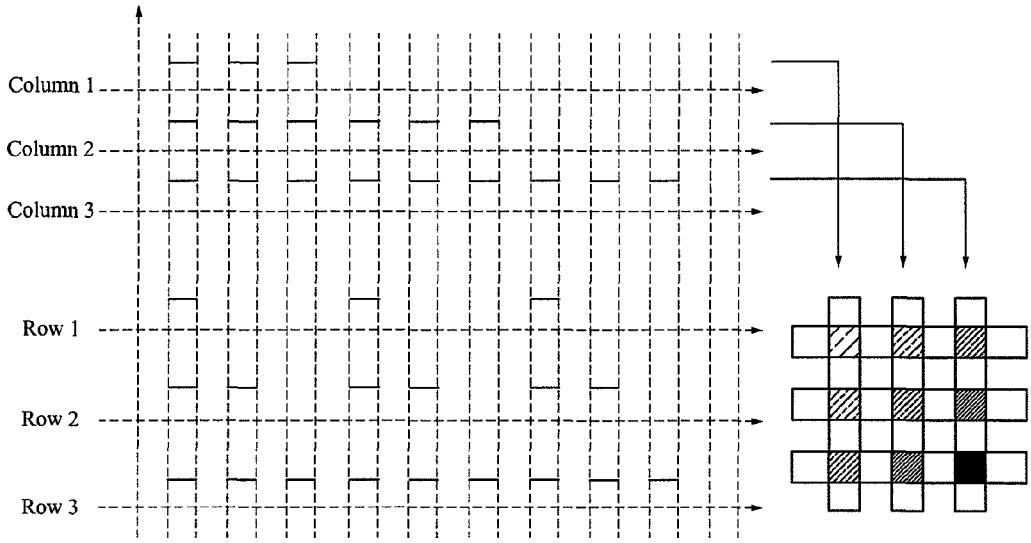
FIG. 4 is a schematic drawing of the multi-line addressing method for a bistable display.

PNM (pulse number modulation) is essentially similar to PWM (pulse width modulation). For a more complete understanding of PNM, refer to FIG. 4. As compared with FIG. 1, FIG. 4 is a schematic drawing of the multi-line addressing (MLA) method for the bistable display. In FIG. 4, the number of pluses on Column 1-3 and Row 1-3 are adjusted for displaying different gray levels.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims herein is not intended to invoke the provisions of 35 U.S.C. §112, 6th paragraph.

What is claimed is:

1. A multi-line addressing apparatus for a bistable display, the multi-line addressing apparatus comprising:

a processor unit for factorizing a basis matrix based on a digital image, wherein the processor unit comprises a first searching module for searching independent vectors in the basis matrix, thereby reducing the rank of the basis matrix;

an identification module for determining whether the digital image is a text-based image or a picture-based image;

a determination module for determining whether an error between two of the independent vectors is within a first predetermined limit when the digital image is the text-based image, or the determination module for determining whether the error between two of the independent vectors is within a second predetermined limit when the digital image is the picture-based image, wherein the first predetermined limit is different from the second predetermined limit;

an adjustment module for replacing any one of the two independent vectors with the other when the error is within the first predetermined limit and when the digital image is the text-based image, or the adjustment module for replacing any one of the two independent vectors with the other when the error is within the second predetermined limit and when the digital image is the picture-based image; and a driving unit for sending a plurality of addressing signals based on the factorized basis matrix to a rectangular array of pixels of the bistable display.

2. The multi-line addressing apparatus of claim 1, wherein the processor unit further comprises:

a second searching module for searching linear dependent vectors in the basis matrix and allocating weights to the searched linear dependent vectors respectively.

3. The multi-line addressing apparatus of claim 1, wherein the bistable display is a quick response liquid powder display, a bistable electrophoretic display or a bistable twisted nematic liquid crystal display.

4. A multi-line addressing apparatus for a bistable display, the multi-line addressing apparatus comprising:

means for factorizing a basis matrix based on a digital image, wherein the factorizing means comprises means for searching independent vectors in the basis matrix, thereby reducing the rank of the basis matrix;

means for determining whether an error between two of the independent vectors is within a first predetermined limit when the digital image is the text-based image, or determining whether the error between two of the independent vectors is within a second predetermined limit when the digital image is the picture-based image, wherein the first predetermined limit is different from the second predetermined limit;

means for replacing any one of the two independent vectors with the other when the error is within the first predetermined limit and when the digital image is the text-based image, or replacing any one of the two independent vectors with the other when the error is within the second predetermined limit and when the digital image is the picture-based image; and means for sending a plurality of addressing signals based on the factorized basis matrix to a rectangular array of pixels of the bistable display.

5. The multi-line addressing apparatus of claim 4, wherein the factorizing means further comprises:

means for searching linear dependent vectors in the basis matrix and allocating weights to the searched linear dependent vectors respectively.

6. The multi-line addressing apparatus of claim 4, wherein the bistable display is a quick response liquid powder display, a bistable electrophoretic display or a bistable twisted nematic liquid crystal display.

7. A multi-line addressing method for a bistable display, the multi-line addressing method comprising:

providing a basis matrix based on a digital image;

factorizing the basis matrix by searching independent vectors in the basis matrix, thereby reducing the rank of the basis matrix;

determining whether the digital image is a text-based image or a picture-based image;

determining whether an error between two of the independent vectors is within a first predetermined limit when the digital image is the text-based image, or determining whether the error between two of the independent vectors is within a second predetermined limit when the digital image is the picture-based image, wherein the first predetermined limit is different from the second predetermined limit;

replacing any one of the two independent vectors with the other when the error is within the first predetermined limit and when the digital image is the text-based image, or replacing any one of the two independent vectors with the other when the error is within the second predetermined limit and when the digital image is the picture-based image; and sending a plurality of addressing signals based on the factorized basis matrix to a rectangular array of pixels of the bistable display.

8. The multi-line addressing method of claim 7, wherein the step of factorizing the basis matrix further comprises:

searching linear dependent vectors in the basis matrix; and allocating weights to the searched linear dependent vectors respectively.

9. The multi-line addressing method of claim 7, wherein the bistable display is a quick response liquid powder display, a bistable electrophoretic display or a bistable twisted nematic liquid crystal display.

* * * * *